United States Patent [19]

Igarashi et al.

[11] Patent Number: 4,553,079

[45] Date of Patent: Nov. 12, 1985

[54] METHOD FOR RETURNING A MOVABLE PART TO THE ORIGINAL POINT

[75] Inventors: Makoto Igarashi, Tokyo; Naoki Kumagami, Sagamihara; Kiichiro Okano, Chiba, all of Japan

[73] Assignee: Toppan Printing Co., Ltd., Tokyo, Japan

[21] Appl. No.: 600,082

[22] Filed: Apr. 13, 1984

[30] Foreign Application Priority Data

Apr. 13, 1983 [JP] Japan ..... 58-65030

[51] Int. Cl.[4] ..... G05G 5/00

[52] U.S. Cl. ..... 318/626; 318/601; 318/603

[58] Field of Search ..... 318/603, 685, 696, 601, 318/626

[56] References Cited

U.S. PATENT DOCUMENTS 3,586,953 6/1971 Markkanen ..... 318/685

*Primary Examiner*—William M. Shoop, Jr.
*Assistant Examiner*—Saul M. Bergmann
*Attorney, Agent, or Firm*—Bacon & Thomas

[57] ABSTRACT

A method of returning a movable top guide to the original point as defined by a frame of a machine body. The method comprises the steps of first moving in one direction the top guide to the frame at a high speed, moving the opposite direction the top guide away from the frame at an intermediate speed for a prescribed length of time after an overrun switch set at a point a little beyond the original point is rendered non-conductive, moving in one direction the top guide to the frame at a low speed and stopping the movement of the top guide when the original point switch provided at the original point is rendered nonconductive.

5 Claims, 3 Drawing Figures

METHOD FOR RETURNING A MOVABLE PART TO THE ORIGINAL POINT

BACKGROUND OF THE INVENTION

This invention relates to a method for returning the movable part of a machine tool which has position control to the original point.

A machine tool, such as a cartoning machine, etc., a guide section, hot melt tank, flap-folding tucker, emboss coder, etc. is made adjustable in respect to its width and height in order to cope with the volume of a variety of cartons. For instance, external threads engageable with internal threads provided in the guide section can be rotated by a servo motor thereby shifting the guide section. The shifting of any movable part is generally done after it has been returned to the original point. The frame of a machine body, for example, is generally regarded as the plane in which the original point is set. In this case, a normally closed switch is provided on the frame. When a movable part approaches the frame to a prescribed extent (this is taken as the original point of the movable part), the normally closed switch is opened. The movable part stops shifting in response to the opening of the switch, thereby effecting its return to the original point.

If the movable part is quickly drawn near the frame in order to shorten the length of time required to return the movable part, the part fails to stop instantly, even if the switch is opened. Therefore, the movable part is undesirably brought back to a point beyond the specified original point, thereby preventing return of the movable part from being precise. Conversely, if the precise return of the movable part is attempted, the movable part must approach the frame slowly, thereby requiring a longer period of time.

SUMMARY OF THE INVENTION

It is accordingly the object of this invention to provide a method for returning a movable part to the original point with high precision without consuming much time.

To attain this object, this invention provides a method for returning a movable part to the original point which comprises a step of moving in one direction the movable part toward the original point at a first speed, a step of moving in the opposite direction the movable part which has reached the original point to be removed therefrom for a prescribed length of time at a second speed lower than the first speed, and a step of moving in one direction the movable part which has been removed from the original point for the prescribed length of time toward the original point at a third speed lower than the second speed, thereby stopping the movable part at the original point.

As described above, according to the movable part returning method of this invention, a movable part is first moved to the original point in one direction at an appreciably high speed, then is moved from the original point in the opposite direction at an intermediate speed for a prescribed length of time, and finally is moved to the original point in one direction at a low speed, thereby ensuring the high precision return of the movable part to the original point. This invention, which first returns the movable part to the original point at a high speed, is faster than one that returns the movable part at a low speed.

DETAILED DESCRIPTION OF THE PREFERRED EMBODIMENT

Figure 1:
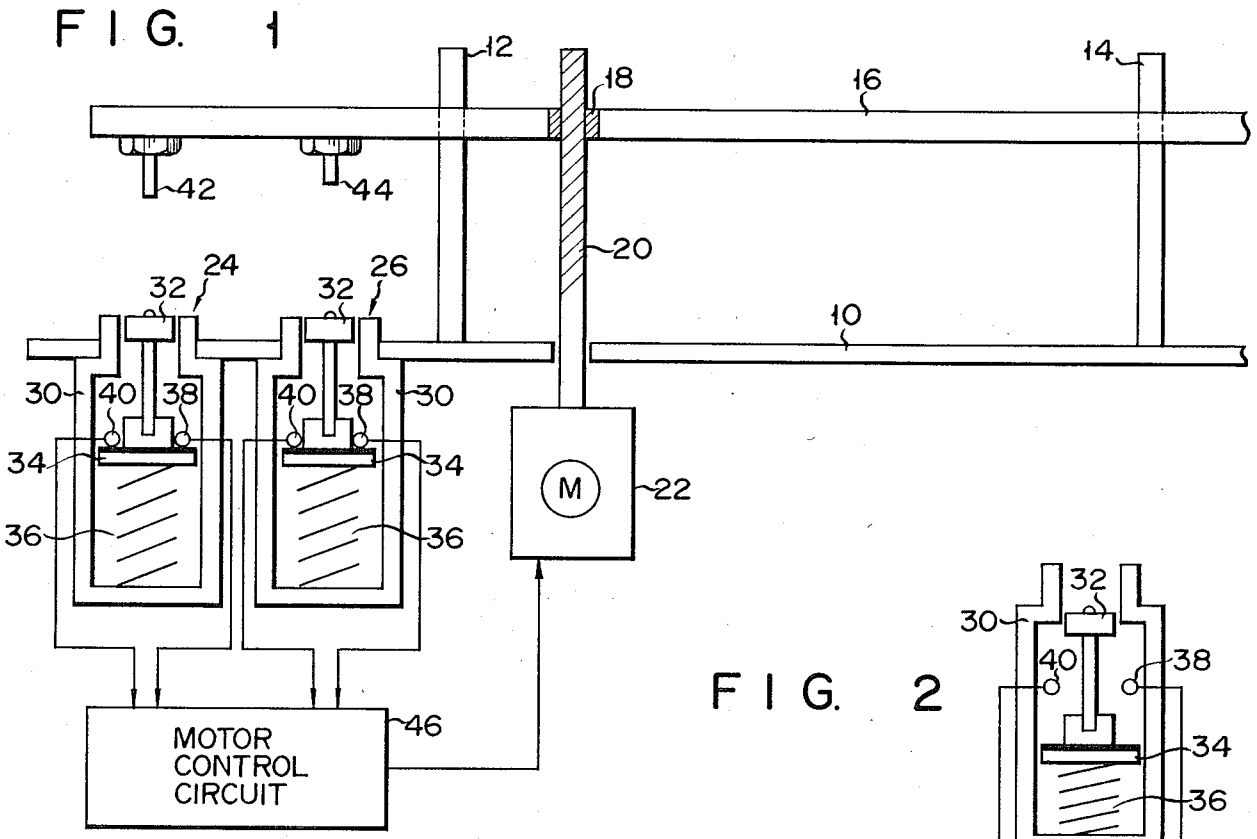
FIG. 1 schematically shows the arrangement of an apparatus for ensuring a method for returning a movable part to the original point according to this invention.
Figure 2:
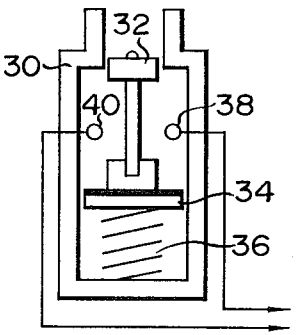
FIG. 2 indicates the open condition of a switch used in the apparatus of FIG. 1.

Description may now be made with reference to the accompanying drawings of a method embodying this invention for the returning the movable part to the original point. In this invention, a movable part is represented by the top guide of a cartoning machine (intended to locate the surface of a traveling carton). In FIG. 1, poles 12, 14 are fitted to a frame 10 of a machine body. A top guide 16 is slidably attached to the poles 12, 14. An internally threaded portion 18 is provided in the top guide 16. An externally threaded portion 20 engageable with the internally threaded portion 18 is connected to the shaft of a servo motor 22 set below the frame 10. Now it is assumed that when the servo motor 22 is rotated clockwise, the top guide 16 is drawn towards the frame 10. The surface of the frame 10 is provided with original point switch 24 and an overrun switch 26 which have the same construction. Each switch comprises a housing 30, an actuator 32, a conduction plate 34 fitted to the lower end of the actuator 32, and a spring 36 positioned below the conduction plate 34. The contacts 38, 40 of the switch are fitted to that portion at which the contacts 38, 40 are contacted with the conduction plate 34 when the spring 36 is in a natural extended condition. Namely, the aforementioned original point switch 24 and overrun switch 26 are normally closed. Poles 42, 44 are provided at a point facing the center of the actuators 32 of the switches 24, 26. When the top guide 16 approaches the frame 10, the poles 42, 44 press downward the actuators 32 of the switches 24, 26 against the urging force of the spring 36. As a result, the conduction plate 32 is thrown out of contact with the switch contacts 38, 40, as shown in FIG. 2, thereby opening the switches 24, 26. It will be noted that the pole 42 is made to be slightly longer (by for example, 0.5 mm) than the pole 44, thereby causing the original point switch 24 to be opened before the overrun switch 26 when the top guide 16 approaches the frame 10. However, it is possible to make the length of the pole 42 equal to that of the pole 44. In this case, the contacts 38 and 40 of the switch 24 need to be on a different level of those of the switch 26. That position of the top guide 16 which leads to the opening of the original point switch 24 is taken as the original point of the movable part.

Output signals from both switches 24, 26 are supplied to a motor control circuit 46. An output signal from the motor control circuit 46 is delivered to the servo motor 22.

Figure 3:
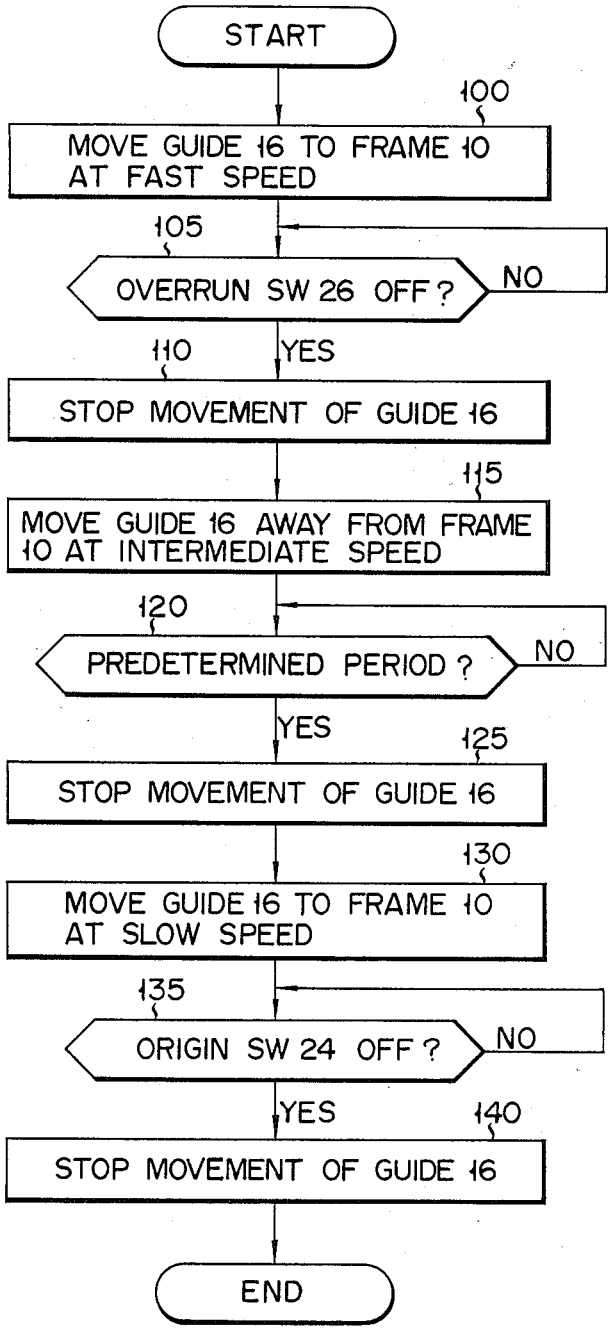
FIG. 3 is a flow chart illustrating the method for returning the movable part to the original point according to this invention.

Description may now be made with reference to the flow chart of FIG. 3 of original point returning method. Reference is first made to the case where the top guide 16 is returned from the position of FIG. 1 to the original point. First, the servo motor 22 is driven clockwise as shown in a step 100 to shift the top guide 16 toward the frame 10. At this time, the servo motor 22 may be driven at a fast speed, thereby causing the top guide 16 to quickly approach the frame 10. The original point switch 24 is opened (left nonconducting) by means of the pole 42. However, this changed condition is disregarded. In a step 105, it is determined whether the overrun switch 26 is nonconductive. When the overrun switch 26 is nonconductive the drive of the servo motor 22 is stopped at a step 110, thereby preventing the top guide 16 from being moved any further. In a step 115, the servo motor 22 is driven counterclockwise at an intermediate speed causing the top guide 16 to be removed from the frame 10 at an intermediate speed for a prescribed length of time. This prescribed length of time is defined in accordance with the difference between the lengths of the poles 42, 44 for rendering both the original point switch 24 and the overrun switch 26 nonconductive and also in accordance with the fast speed at which the top guide 16 is made to approach the frame 10. The top guide 16 is brought back a little from the frame 10 according to this backward movement. In a step 120, it is determined whether a prescribed length of time has lapsed since the start of the backward movement of the top guide 16. If it is found that the time has elapsed, the drive of the servo motor 22 is brought to an end at a step 125. In a step 130, the servo motor 22 is driven clockwise at a low speed to cause the top guide 16 to approach the frame 10. At a step 135, it is determined whether the original point switch 24 is rendered nonconductive. The top guide 16 continues to move at a low speed, until it is found that the original point switch 24 is rendered nonconductive. When the original point switch 24 is rendered nonconductive, the servo motor 22 ceases to be driven at a step 140. Therefore, any further approach of the top guide 16 to the frame 10 is prevented. Since this approach is carried out at a low speed, the top guide 16 can be stopped as soon as the original point switch 24 is nonconductive. As described above, the movable part-returning method of this invention comprises the steps of causing the top guide 16 to be first brought back to the original point (actually a little beyond the original point) at high speed in a short length of time of later carrying the top guide 16 for a short distance in an opposite direction at an intermediate speed, and then finally of moving it to the original point at a low speed. Therefore, the subject movable part-returning method enables a movable part to exactly regain its original position in a shorter period of time than in the conventional movable part-returning method which applies a low speed throughout the process to return a movable part to its original point.

It will be noted that this invention is not limited to the foregoing embodiment. Namely, the overrun switch 26 can be dispensed with. If this is done, it is advised to convert the step 105 of FIG. 3 to a step which determines whether the original point switch 24 is rendered nonconductive. The above-mentioned embodiment refers to the use where a movable part is represented by a top guide involved in a cartoning machine. Obviously, this invention is not limited to this case.

What is claimed is:

1. A method for returning a movable part to the original point which comprises:

a first step of moving a movable part in one direction to the original point at a first speed causing the movable part to stop at a point a little beyond the original point;

a second step of moving the movable part in the opposite direction away from the original point at a second speed lower than said first speed for a prescribed length of time causing the movable part to be slightly removed from the original point;

a third step of moving the movable part which has been moved away from said original point for said prescribed length of time to the original point at a third speed lower than said second speed and, thereby stopping the movable part at said original point; and, providing an original point switch at the original point and an overrun switch at a point a little beyond the original point such that, in the first step, the movable part continues to move until the movable part contacts the overrun switch, and in the third step, the movable part continues its travel until the movable part contacts the original point switch.

2. A method according to claim 1 wherein the original point switch and the overrun switch are normally closed switches and are opened when contacted by the movable part.

3. An apparatus for returning a movable part to the original point which comprises:

actuator means for moving the movable part in a first direction and a second direction;

an original point switch which is located at the original point;

an overrun switch which is located a little beyond the original point, such that the original switch is first contacted with the movable part and then the overrun switch is contacted with the movable part when the movable part is moved in the first direction; and, returning means connected to said actuator means, original point switch, and overrun switch for moving said movable part in the first direction at a first speed, this movement continuing when the movable part contacts the overrun switch, next for moving said movable part in the second direction at a second speed lower than the first speed for a prescribed period of time, and then for moving said movable part in the first direction at a third speed lower than the second speed, this movement continuing until the movable part contacts the original point switch.

4. An apparatus according to claim 3, wherein said prescribed period of time is set such that the movable part can be returned to a point a little before the original point, after the movable part moves for said prescribed period of time.

5. An apparatus according to claim 3, wherein said original point switch and said overrun switch are both normally closed switches, and when the movable part contact the original point, said original point switch being opened and the movable part being stopped.

* * * * *